United States Patent [19]

Henry

[11] Patent Number: 5,076,546

[45] Date of Patent: Dec. 31, 1991

[54] MODULAR BARRIER AND RESTRAINT FOR CHILDREN OR INFANTS

[76] Inventor: Winsome A. Henry, P.O. Box 175, Bon Aqua, Tenn. 37025

[21] Appl. No.: 520,090

[22] Filed: May 7, 1990

[51] Int. Cl.[5] ..... E04H 17/16

[52] U.S. Cl. ..... 256/24; 403/346; 52/668; 5/99.1

[58] Field of Search ..... 256/24, 25; 403/346; 52/668; 5/99 B, 99.1

[56] References Cited

U.S. PATENT DOCUMENTS

| | | | |
|---|---|---|---|
| 2,069,391 | 2/1937 | Sample | 52/688 |
| 2,665,433 | 1/1954 | Weidt | 5/99 B |
| 3,844,471 | 10/1974 | Hind | 5/99 B X |

*Primary Examiner*—Andrew V. Kundrat

*Attorney, Agent, or Firm*—Mark J. Patterson; Edward D. Lanquist, Jr.

[57] ABSTRACT

A modular barrier and restraint for children or infants. The device has several interchangeable pieces, including substantially elongated barriers, rectangular end pieces, pyramidal end pieces, and castle end pieces. This interchangeability allows a one-dimensional, two-dimensional, three-dimensional, or four-dimensional barrier. Each piece is fitted with either a slot or counter slot to be fitted together to easily form the barriers. Holes may be placed through the pieces to form a handle. Other holes may be placed into or through the pieces to either provide a place through which a child or infant can see or into which a mirror can be placed.

1 Claim, 3 Drawing Sheets

MODULAR BARRIER AND RESTRAINT FOR CHILDREN OR INFANTS

BACKGROUND OF THE INVENTION

The present invention relates generally to a device for child care and more particularly to a modular barrier and restraint for children or infants.

It will be appreciated by those skilled in the art that children will roam around if not within a certain confinement. Further, adults caring for children often need to have the ability to move from room to room and take the child with them, yet maintain confinement. To this end, there have been numerous attempts to provide such a device for confinement of children. One such attempt is the generally known play pen that is slightly more mobile than a crib.

Another such attempt was disclosed by J. E. Irby in U.S. Pat. No. 3,708,808, issued on July 9, 1973. The Irby patent discloses an "Infant Restrainer" to be used in conjunction with a bed. However, the Irby device is fairly complex and cumbersome to move. Further, the Irby device provides only dual-sided confinement and is meant to be used with a small infant lying on a bed.

Another such attempt is disclosed in U.S. Pat. No. 3,338,213, issued to A. D. Spencer on Sept. 5, 1962, for a "Combination Play Yard, Sandbox, and Wading Pool" The Spencer device is also very complex and cumbersome to move. Further, it cannot and need not take advantage of existing barriers such as walls, thereby resulting in unneeded barriers in certain applications.

U.S. Pat. No. 3,430,271, issued to M. Junod Dodeile on Mar. 4, 1969, discloses a "Child's Play Pen". This device is merely an inflatable continuous barrier that must be deflated to be transported and then inflated to be used.

Other attempts have been in the form of play pens and cribs which are exemplified in U.S. Pat. No. 3,680,155, issued to McMann; U.S. Pat. No. 3,080,573, issued to Marsman; U.S. Pat. No. 4,692,953, issued to Fedders; U.S. Pat. No. 4,750,223, issued to D'Arcy; U.S. Pat. No. 4,765,004, issued to Kessel; and U.S. Pat. No. 4,819,285, issued to Fedders. However, none of these cribs and play pens provide an easily transportable confinement device. Also, none of these cribs and play pens provide a simple barrier that can take advantage of an existing barrier such as a wall or door. Still further, none of these pens and cribs provide interchangeable walls.

What is needed, then, is a modular barrier restraint for children or infants that can be easily placed and moved so that a child can be restrained in many different areas. This needed modular barrier and restraint for children or infants must also be sufficiently interchangeable to allow placement in many different configurations to allow sufficient containment of a child in many different environments. What is also needed is a modular barrier and restraint for children and infants that helps the child have fun within the confinement of the unit.

SUMMARY OF THE INVENTION

In the present device, various members are joined substantially perpendicularly to create a modular barrier and restraint for children and infants. One piece, a substantially elongated barrier, has a slot on each end. Each slot may receive a counter slot from either an elongated barrier or an end piece. A supported one-dimensional barrier is created by connecting one end piece at each of the slots of the elongated barrier. A supported two-dimensional barrier is created by joining two elongated barriers and an end piece with one of the elongated barriers. A supported three-dimensional barrier can be created by joining three elongated barriers. A four-dimensional supported containment unit can be created by joining four elongated barriers or two elongated barriers with two end pieces. Openings can be placed through any of the pieces to allow the child or infant to look through the barrier or end piece. Mirrors can be placed in the openings to allow the child to view himself or herself. Further, mirrors may be placed in holes that do not fully penetrate the barrier or end pieces. Handle openings can be placed through the various pieces to allow ease of mobility.

Accordingly, an object of the present invention is to provide a modular barrier and restraint for children or infants that can be easily placed and moved so that a child can be placed in many different areas.

Another object of the present invention is to provide a modular barrier and restraint for children or infants that is sufficiently interchangeable to allow placement in many different configurations to allow sufficient containment of the child or infant.

Still another object of the present invention is to provide a modular barrier and restraint for children or infants that allows the child to have fun within the confinement.

Still a further object of the present invention is to provide a confinement unit that is easily and inexpensively constructed.

DESCRIPTION OF THE PREFERRED EMBODIMENT

Figure 1:
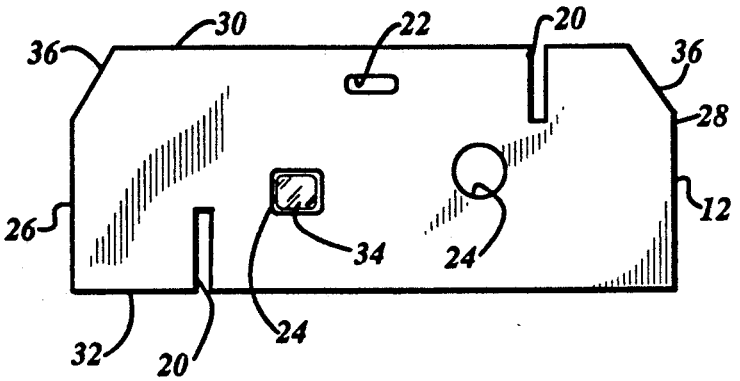
FIG. 1 is a frontal view of the substantially elongated barrier of the present device.
Figure 5:
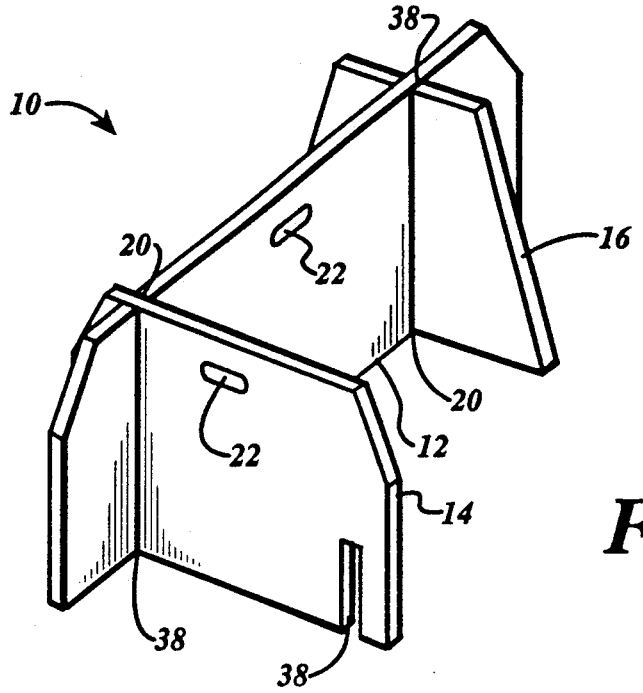
FIG. 5 is a perspective view showing a substantially elongated barrier supported by a pyramidal end piece at one end and a six-sided end piece at another end, thereby forming a one-dimensional or two-dimensional barrier.
Figure 6:
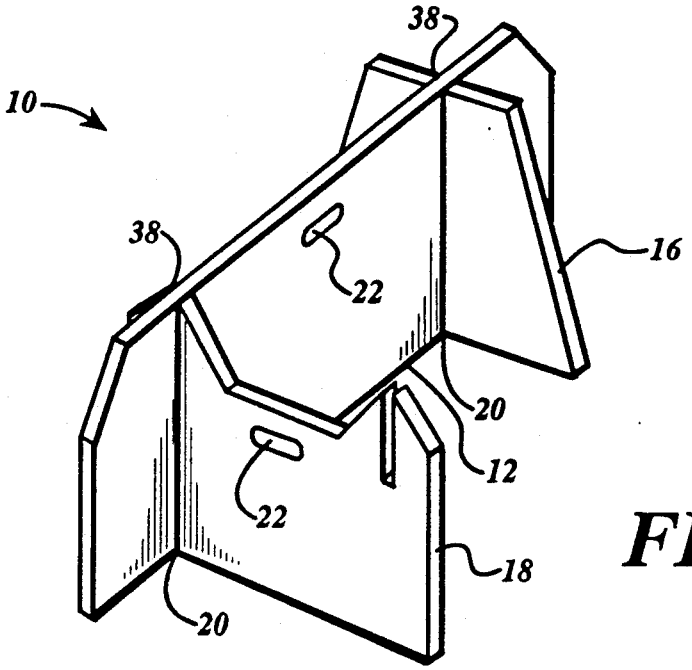
FIG. 6 is a perspective view of a one-dimensional or two-dimensional barrier having a substantially elongated barrier supported by a pyramidal end piece and a castle-like end piece, thereby forming a one-dimensional or two-dimensional barrier.
Figure 7:
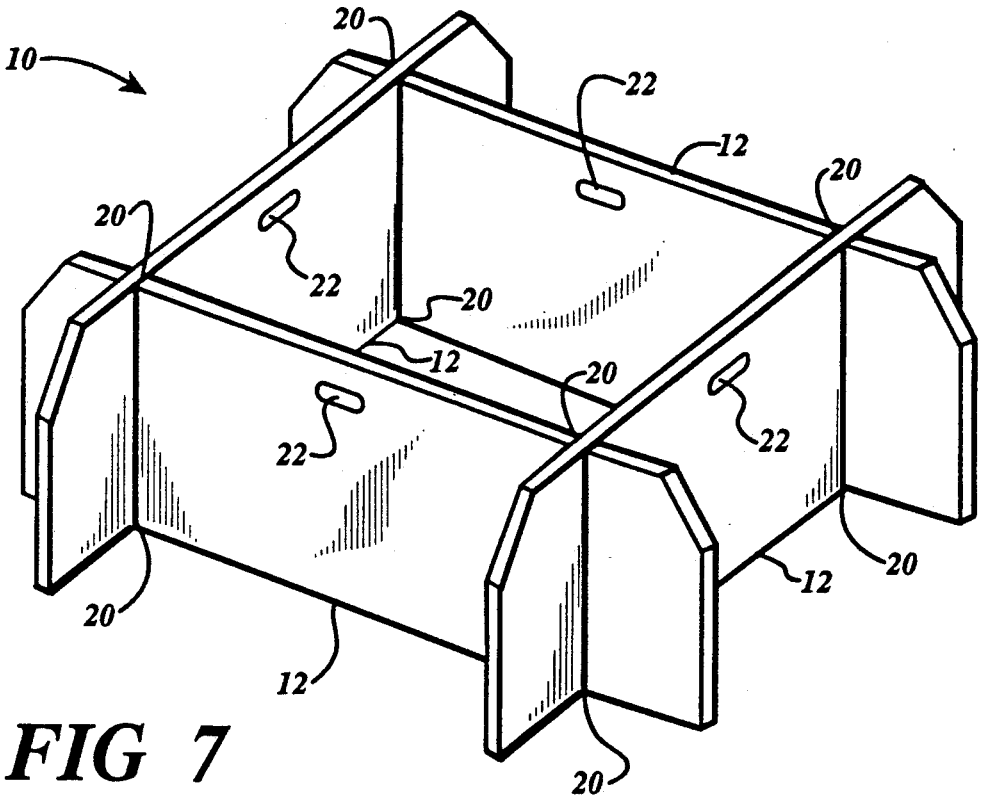
FIG. 7 is a perspective view of a four-dimensional barrier having four elongated barriers connected together.

Referring now to FIG. 1, there is shown generally at 12 the substantially elongated barrier that is used to create the modular barrier and restraint for children or infants (10 in FIGS. 5, 6, and 7). Substantially elongated barrier 12 has first end 26, second end 28, upper side 30, and lower side 32. Slots 20 are placed through barrier 12 in substantially perpendicular alignment with said sides 30, 32. Opening 22 is placed through barrier 12 to allow easy carrying of barrier 12. Holes 24 are placed through barrier 12 to allow the child or infant to see through barrier 12. Mirror 34 is placed in hole 24 to allow the child or infant to see himself and to make confinement more enjoyable. Mirror 34 may also be placed in a hole or recessed area that does not fully penetrate the barrier. As can be seen in FIG. 1, the intersection between upper side 30 and ends 26, 28, is beveled. However, bevels 36 are not required. Further, slots 20 can be placed on different sides 30, 32, as shown in FIG. I or can both be on upper side 30, or both on lower side 32. In the preferred embodiment, slots 20 are placed to penetrate half the distance between sides 30, 32.

Figure 2:
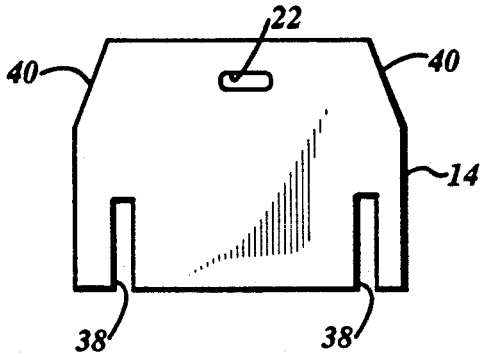
FIG. 2 is a frontal view of the substantially rectangular, six-sided end piece of the present device.

Referring now to FIG. 2, there is shown generally at 14 the substantially rectangular, six-sided end piece. Bevels 40 are shown in FIG. 2. However, bevels 40 are not required. Counter slots 38 are placed in rectangular end piece 14. As shown in FIGS. 5 and 6, counter slots 38 are designed to receive slots 20 of elongated barrier 12. Handle openings 22 ? an be placed through rectangular end piece 14 as can holes 24 for mirrors 34, even though not shown in FIG. 2. Counter slots 38 are adapted to equal approximately half the height of rectangular piece 14.

Figure 3:
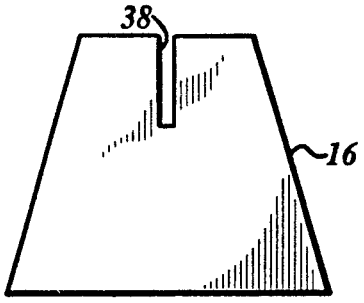
FIG. 3 is a frontal view of the pyramidal end piece.

Referring now to FIG. 3, there is shown generally at 16 the pyramidal end piece 16 of the present invention. In the preferred embodiment, counter slot 38 is located at substantially the mid-point of pyramidal end piece 16. Therefore, when counter slot 38 receives slot 20 of elongated barrier 12 as shown in FIGS. 5 and 6, pyramidal end piece 16 provides support bilaterally. However, pyramidal end piece 16 can be widened and have more than one counter slot 38 placed from either top to bottom or bottom to top. Also, though not shown in FIG. 3, pyramidal end piece 16 can have handle openings 22, holes 24, and mirrors 34.

Figure 4:
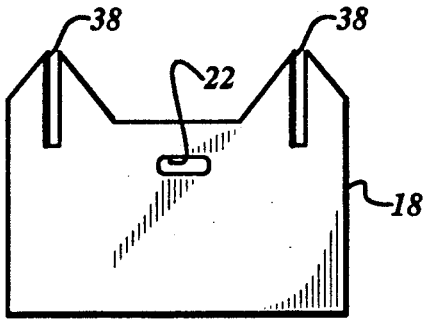
FIG. 4 is a front view of the castle-like end piece.

Referring now to FIG. 4, there is shown generally at 18 the castle-like end piece of the present device. Counter slots 38 are adapted to equal approximately half the height of castle-like end piece 18. End piece 18 Can have handle openings. Also, though not shown, end piece 18 can have holes 24 and mirror 34. Counter slots 38 can also be placed from either top to bottom or bottom to top to receive slots 20 of elongated barrier 12 as shown in FIG. 6.

Referring now to FIG. 5, there is shown generally at 10 one embodiment of the modular barrier and restraint for children or infants of the present invention. Slots 20 of barrier 12 receive counter slot 38 of pyramidal end piece 16 and counter slot 38 of rectangular end piece 14. Pyramidal end piece 16 and rectangular end piece 14 are substantially perpendicular to elongated barrier 12. Handle openings 22 are placed in both elongated barrier 12 and rectangular end piece 14. Although not shown, handle opening 22 can be placed in pyramidal end piece 16, and holes 24 and mirrors 34 can be placed in any of pieces 12, 14, or 16.

Referring now to FIG. 6, there is shown another embodiment of modular barrier and restraint for children or infants 10. In FIG. 6, castle-like end piece 18 has replaced rectangular end piece 14 of FIG. 5. The configuration of castle-like end piece 18 is such that a child Or infant can much more easily see over castle-like end piece 18. The embodiments of FIGS. 5 and 6 would be useful to protect doorways and stairs.

Referring now to FIG. 7, there is shown generally at 10 still another embodiment of the modular barrier and restraint for children or infants. In this instance, four substantially elongated barriers 12 have been connected to create a four-dimensional barrier or confinement. As is true throughout, handle openings 22, holes 24, and mirrors 34 can be placed on any of the barriers 12.

Referring now to FIGS. 1–7, in the preferred embodiment, each barrier 12 and piece 14, 16, and 18 is substantially 24 inches tall from bottom to top. Slots 20 and counter slots 38 are substantially 12 inches long and either one-quarter or three-eighths inches wide, depending upon the thickness of the material used. In the preferred embodiment, barriers 12 and pieces 14, 16, and 18 are constructed from plywood or plastic that is either one-quarter or three-eighths inches thick. Also, in the preferred embodiment, holes 24 that receive mirror 34 are not cut all the Way through barrier 12 or piece 14, 16, or 18, but instead are cut partially through to provide a frame for mirror 34.

Thus, although there have been described particular embodiments of the present invention of a modular barrier and restraint for children or infants, it is not intended that such references be construed as limitations upon the scope of this invention, except as set forth in the following claims. Further, although there have been described certain dimensions used in the preferred embodiment, it is not intended that such dimensions be construed as limitations upon the scope of this invention, except as set forth in the following claims.

What I claim is:

1. A modular barrier and restraint for children or infants comprising:

a. a substantially elongated barrier having a first end, a second end, an upper side, a lower side, a first slot proximate to said first end, and a second slot proximate to said second end, said slots aligned substantially perpendicularly to said sides and penetrating half the distance between said sides;

b. a first end piece having a counter slot for receiving said first slot such that said elongated barrier and said end piece are joined substantially perpendicularly;

c. a second end piece having a counter slot for receiving said second slot such that said elongated barrier and said second end piece are joined substantially perpendicularly;

d. said elongated barrier having a hole placed through it so that a child can see through said barrier; and e. a mirror placed in said hole of said elongated barrier.

* * * * *